United States Patent [19]

Matthews et al.

[11] 4,091,473

[45] May 30, 1978

[54] ADJUSTABLE TOILET

[76] Inventors: William C. Matthews; Eunice C. Matthews, both of 322 Rutland, Wichita, Kans. 67208

[21] Appl. No.: 742,599

[22] Filed: Nov. 17, 1976

[51] Int. Cl.[2] ..... E03D 11/00; E03D 11/14

[52] U.S. Cl. ..... 4/420; 4/251; 4/300

[58] Field of Search ..... 4/10, 185 L, 251, 254, 4/252 R; 297/DIG. 4

[56] References Cited

U.S. PATENT DOCUMENTS

| | | | |
|---|---|---|---|
| 2,145,435 | 1/1939 | Smith | 4/DIG. 2 |
| 2,187,283 | 1/1940 | Scheutz | 4/185 L X |
| 2,813,277 | 11/1957 | Zillt | 4/185 L |
| 3,686,695 | 8/1972 | Mielback | 4/252 R |
| 3,914,806 | 10/1974 | Pearce | 4/185 L X |

*Primary Examiner*—Steven L. Stephan
*Assistant Examiner*—Stuart S. Levy
*Attorney, Agent, or Firm*—Edwin H. Crabtree; John H. Widdowson

[57] ABSTRACT

An adjustable toilet mounted on the wall of a bathroom. The toilet is raised and lowered by an electrically driven motor. By raising and lowering the toilet, the elderly, the handicapped, and children are aided in the use of the toilet. The toilet provides electrical limit switches for stopping the motor at a desired height above the bathroom floor.

4 Claims, 4 Drawing Figures

ADJUSTABLE TOILET

BACKGROUND OF THE INVENTION

This invention relates generally to toilets and more particularly, but not by way of limitation, to a wall mounted toilet which is adjustable in height above the floor of a bathroom.

Heretofore, there have been various types of prior art toilets which are adjustable in height from the floor of the bathroom. The toilets are adjustable by hand operated jacks, hydraulic pressure, and various other types of mechanical linkage. None of the prior art toilets provide an electrically driven adjustable toilet having the novel structure and advantages of the subject invention.

SUMMARY OF THE INVENTION

The adjustable toilet is adaptable for mounting on the side of a bathroom wall. The toilet is raised and lowered electrically through the use of an electric motor. The motor is operated by an electric pressure switch.

As a rule, people do not like to be assisted in the use of the bathroom. People who are elderly or in ill health find asking for help in using the toilet a source of embarrassment. A toilet of standard height is often difficult to use because it may be either too high or low. Also, people who are in a wheel chair often find the height of the wheel chair does not correspond with the height of the toilet. The subject invention allows the user of the toilet to adjust the height of the toilet accordingly, so that no assistance is required.

Also, by lowering the toilet children are helped in proper potty training and sanitary conditions around the area of the toilet are greatly improved.

The invention provides electrical limit switches as a safety feature to prevent the toilet from either being raised too high or raised too low to prevent the possible distruction of the toilet or motor. Also, a limit switch is mounted at the bottom of the toilet so stop the toilet should an object be inadvertently placed under the toilet.

The adjustable toilet includes a wall mounted toilet having a vertical base with a mounting bracket attached thereto. A flexible waste pipe line and flexible water supply line are attached to the toilet. An electric motor having a gear drive is attached to a back plate disposed at the rear of the toilet. A pair of vertical parallel worm gears are mounted at both ends on the back plate and are driven by idle sprockets attached to the worm gears. The sprockets are driven by a chain drive attached to the drive gear of the motor. Limit switches are mounted on the back plate and positioned adjacent the upper and lower ends of the vertical worm gears so that when the toilet is raised too high or too low the motor will be stopped.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
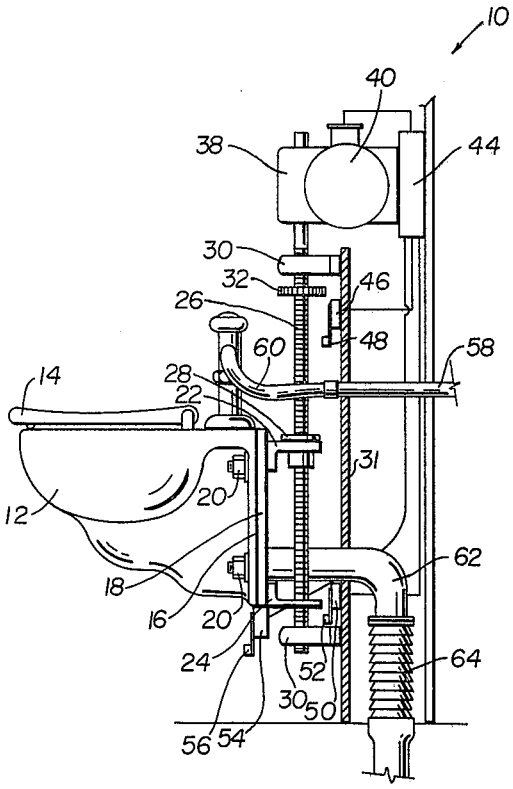
FIG. 1 is a side view of the adjustable toilet mounted on the wall of a bathroom.
Figure 3:
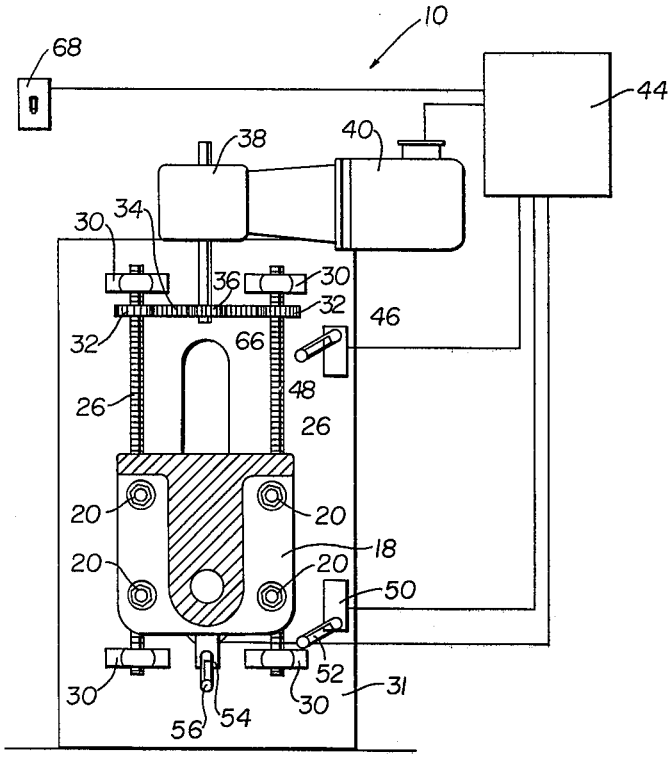
FIG. 3 is a front view of the adjustable toilet with the toilet bowl removed.

In FIG. 1, the adjustable toilet is designated by general reference numeral 10. The toilet 10 includes a toilet bowl 12, a toilet seat 14, and a vertical base 16 attached to a mounting bracket 18. The bowl 12 may be any commercially available toilet suitable for mounting on a wall. The base 16 is attached to the mounting bracket 18 by threaded bolts 20. The bolts 20 extend through the mounting bracket 18 and are secured to upper guides 22 and lower guides 24. The guides 22 and 24 are disposed around a pair of elongated vertical worm gears 26. The worm gears 26 are threadably attached to threaded bearings 28 mounted in the upper guides 22. It should be noted that in this view only one of the worm gears 26 is seen attached to guides 22 and 24. Both of the gears 26 are shown in FIG. 3. By rotating the gears 26, the bearings 28 are raised and lowered thereon, and the height of the bowl 12 is adjusted accordingly. The gears 26 are held in place by cheek blocks 30 attached to both ends of the gears 26. The blocks 30 are mounted on a back plate 31.

Figure 4:
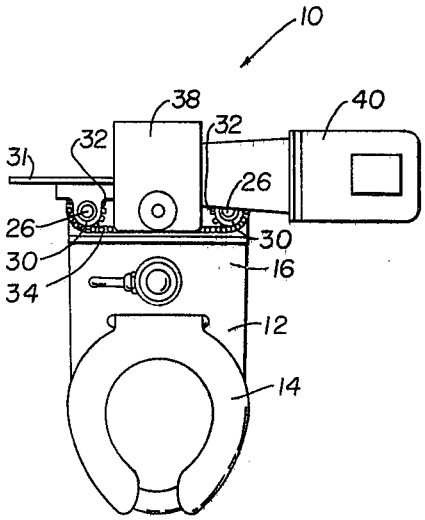
FIG. 4 is a top view of the adjustable toilet.

The worm gears 26 are driven by idle sprockets 32 attached to the top thereof. The sprockets 32 are driven by an endless chain 34 which is shown in FIGS. 3 and 4. The chain 34 is driven by a gear drive 36 shown in FIG. 3. The gear drive 36 is connected to a gear reduction box 38. The box 38 is attached to and driven by an electric motor 40. The motor 40 is electrically connected to a control panel 44.

Attached to the front of the back plate 31 is an upper limit switch 46 having a switch arm 48 and a lower limit 50 having a switch arm 52. The bowl 12 is mounted on the back plate 31 and attached to the worm gears 26 so that the motor 40 driving the worm gear 26 will raise and lower the bowl 12 within a predetermined distance. For example, the bowl 12 may be raised from its lowest position above the floor to its highest position with the differential being from 12 to 24 inches. Should the bowl 12 be raised above the highest predetermined position, the upper guide 22 will contact the switch arm 48, which in turn will turn off the power supply to the motor 40 thereby stopping the travel of the bowl 12. In turn, when the bowl 12 is lowered beyond the predetermined lowest position, the lower guide 24 will contact the lower switch arm 52 and the power to the motor 40 will be stopped.

An additional safety feature of the adjustable toilet 10 is a limit switch 54 mounted on the bottom of the mounting plate 18 having a switch arm 56 extending downwardly therefrom. Should an object inadvertently be placed under the bowl 12 while the toilet 10 is being lowered, or should the foot or part of the body of the user of the toilet 10 by accident come in contact with the switch arm 52, the power to the motor will be stopped.

The toilet bowl 12 is supplied with water through a supply line 58 attached to a flexible line 60. The bowl 12 is also connected to a waste pipe line 64. The flexible water supply line 60 and waste line 64 provide sufficient slack in the lines so that the bowl 12 may be raised and lowered on the back plate 31. The flexible lines 60 and 64 may be made of plastic, metal, or any other flexible type material which is acceptable as a plumbing line.

Figure 2:
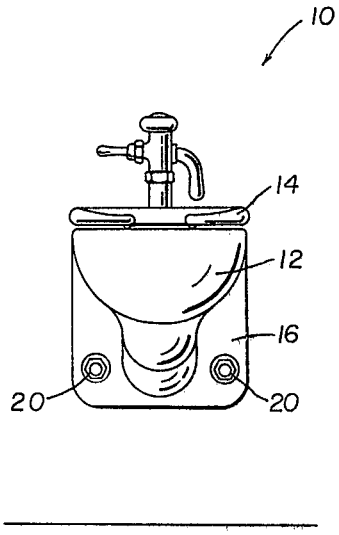
FIG. 2 is a front view of the adjustable toilet.

In FIG. 2, a front view of the toilet 10 is illustrated with the bowl 12 attached to the side of a bathroom wall. The view would be typical of an insulation on a wall except for slots which will be required and cut in the wall so that the bowl 12 may be raised and lowered on the back plate 31. The back plate 31 would normally be positioned inside the bathroom wall and attached thereto.

In FIG. 3, the bowl 12 has been removed from the mounting bracket 18 and a front view of the back plate 31 and worm gears 26 are illustrated. An elongated vertical slot 66 is seen in the back plate 31. The slot 66 is necessary for feeding the waste line 62 therethrough so that the bowl 12 may be raised and lowered with the waste line 62 raising and lowering inside the slot 66. Also seen in this view are the vertical parallel worm gears 26 mounted on the cheek blocks 30 with the idle sprockets 32 driven by the chain 34 attached to the drive gear 36.

The limit switches 46, 50, and 54 are also shown wired to the electrical control panel 44. The control panel 44 is wired to an electrical pressure switch 68 which is mounted on the side of the bathroom wall and adjacent the adjustable toilet 10. By moving the pressure switch 68 upward, the toilet bowl 12 is raised. In turn, when the pressure switch 68 is moved downward, the toilet bowl 12 is lowered. When the pressure on the switch 68 is released, the motor 40 stops.

In FIG. 4, a top view of the adjustable toilet 10 is illustrated. In this view, the top of the idle sprockets 32 can be seen engaging the chain 34. Also shown are the cheek blocks 30 with the top of the worm gears 26 extending therethrough.

Changes may be made in the construction and arrangement of the parts or elements of the embodiments as described herein without departing from the spirit or scope of the invention as defined in the following claims.

I claim:

1. An adjustable toilet, for mounting on a vertical wall the toilet comprising:

a wall mounted toilet bowl having a verical base said bowl having a supply line and a discharge line;

a mounting bracket attached to said base;

a flexible waste pipe line attached to the discharge line of said toilet bowl;

a flexible water supply line attached to the supply line of said toilet bowl;

an electric motor mounted on the wall and having a drive gear attached thereto:

a back plate spaced from the wall and positioned at the rear of said toilet bowl, said back plate having cheek blocks mounted thereon;

a pair of vertical parallel worm gears mounted at both ends to said cheek blocks;

a pair of upper guides attached to said mounting bracket and having bearings mounted thereon, said bearings threadably engaging said worm gears;

a pair of lower guides attached to said mounting bracket and disposed around said worm gears; and idle sprockets attached to the upper portion of said worm gears, said idle sprockets chain driven by said drive gear.

2. The toilet as described in claim 1, further including an upper and lower limit switch mounted on said back plate, said switches having switch arms disposed adjacent said upper and lower guides and contacting said guides for stopping said electric motor when said toilet is raised or lowered beyond a predetermined distance.

3. The toilet as described in claim 1, further including a limit switch mounted on the lower portion of said mounting bracket and having a switch arm extending downwardly therefrom for stopping said electric motor when coming into contact with an object on the floor below said toilet.

4. The toilet as described in claim 1, wherein said back plate includes an elongated vertical slot in the center thereof, said slot receiving a portion of said toilets' waste line therethrough.

* * * * *